United States Patent [19]

Melnyk et al.

[11] Patent Number: 4,485,867

[45] Date of Patent: Dec. 4, 1984

[54] HEAT EXCHANGER

[75] Inventors: William Melnyk, Lathrup Village; Robert P. Fries, West Bloomfield, both of Mich.

[73] Assignee: Ex-Cell-O Corporation, Troy, Mich.

[21] Appl. No.: 346,665

[22] Filed: Feb. 8, 1982

[51] Int. Cl.[3] ..... F28F 9/02; F28F 9/04; F28F 9/14; F28F 9/16

[52] U.S. Cl. ..... 165/173; 165/176; 165/178; 285/336; 285/339; 285/364

[58] Field of Search ..... 165/173, 178, 153, 152, 165/151, 149, 175; 285/336, 339, 347, 349, 342, 364

[56] References Cited

U.S. PATENT DOCUMENTS

| | | | |
|---|---|---|---|
| 771,682 | 10/1904 | Sussman | 285/364 |
| 1,178,714 | 4/1916 | Griffin | 285/349 |
| 2,097,628 | 11/1937 | Liebhardt | 285/349 |
| 3,027,142 | 3/1962 | Albers et al. | 165/151 |
| 3,583,478 | 9/1971 | Fieni | 165/178 |
| 3,628,603 | 12/1971 | Fieni | 165/176 |
| 3,792,729 | 7/1972 | Perry | 165/76 |
| 3,847,420 | 11/1974 | Seville | 285/336 |
| 3,993,126 | 11/1976 | Taylor | 165/79 |
| 4,231,424 | 11/1980 | Moranne | 165/174 |
| 4,351,390 | 9/1982 | Argyle et al. | 285/364 |
| 4,401,157 | 8/1983 | Cadars | 165/173 |

FOREIGN PATENT DOCUMENTS

| | | | |
|---|---|---|---|
| 22234 | 1/1981 | European Pat. Off. | 165/173 |
| 2816291 | 10/1979 | Fed. Rep. of Germany | 165/175 |
| 2259344 | 8/1975 | France | 165/175 |
| 2270471 | 12/1975 | France | 165/175 |
| 2205023 | 1/1980 | United Kingdom | 165/175 |

*Primary Examiner*—William R. Cline
*Assistant Examiner*—John K. Ford
*Attorney, Agent, or Firm*—John P. Moran

[57] ABSTRACT

There is illustrated and described herein a heat exchanger including rows of tubes, a pair of headers secured to the ends of the tubes, a groove formed in each of the headers adjacent the peripheral wall thereof and intermediate adjacent rows of tubes, a recessed portion formed along the full length of the centerline of each groove, a pair of tanks having walls aligned with and mounted in the grooves of the respective headers, a ledge formed around the outside wall of each header, a chamfer formed along each of the inner and outer edges of the tank walls to form a blunt edge at the ends of the chamfers, and a gasket mounted in each groove and depressed along its centerline into said recessed portions by the blunt edge, the tanks being retained in position by bending spaced extensions of the peripheral wall of each header onto the ledge.

3 Claims, 3 Drawing Figures

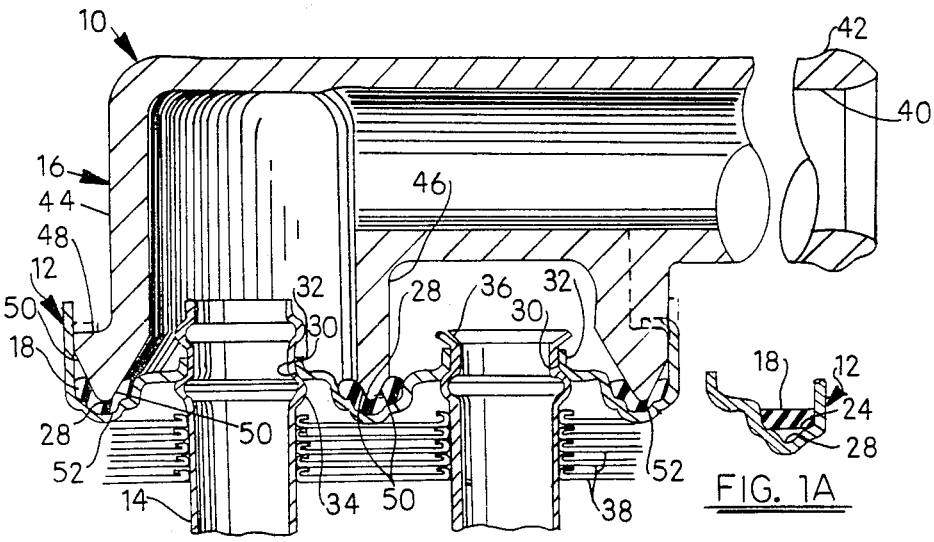
FIG. 1A
FIG. 1
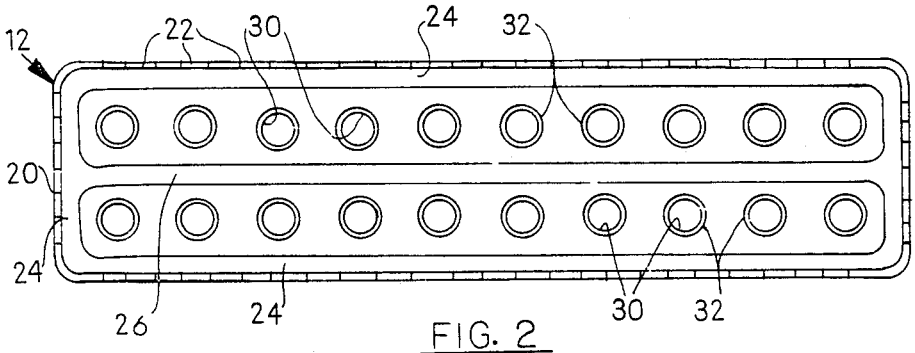
FIG. 2
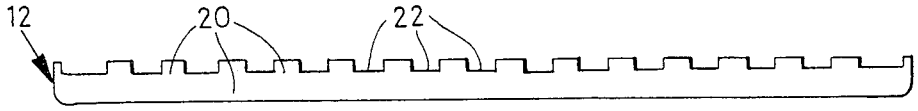
FIG. 3

HEAT EXCHANGER

TECHNICAL FIELD

This invention relates generally to heat exchangers and, more particularly, to heat exchangers wherein the tank and header are joined by a mechanical clamping arrangement without the use of soldering or welding.

BACKGROUND ART

Heretofore, when a solderless tank to header arrangement was used, the gaskets used therein either were formed in various non-planar shapes in order to help assure a positive seal, or were retained flat and clamped by flat header surfaces requiring considerable clamping force to compress the gasket over the sealing area. Examples of such solderless prior art are Fieni U.S. Pat. Nos. 3,583,478 and 3,628,603; Albers et al U.S. Pat. No. 3,027,142; Taylor U.S. Pat. No. 3,993,126; and Perry U.S. Pat. No. 3,792,729.

DISCLOSURE OF THE INVENTION

It is an object of this invention to provide an improved heat exchanger including a solderless tank to header joint wherein a gasket is efficiently used between the tank and the header without requiring the application of a substantial clamping force.

Another object of the invention is to provide a solderless heat exchanger including a tank to header joint having a gasket embodied therein which is flat in its free state but which is deformed into a recessed portion formed in the header by a tapered edge portion formed on the tank, thus providing a leak-proof seal between the tank and the header.

A further object of the invention is to provide a solderless heat exchanger including a contoured header mounted on each end section of a plurality of tubes, a plastic tank mounted on each header, with a flat gasket placed therebetween in grooves formed in the header, but wherein the gasket is depressed by blunt-nosed edges formed on the inner edges of the tank into a centerline recess formed in the bottom of the grooves to provide a leak-proof seal at each end of the heat exchanger.

These and other objects and advantages will become apparent when reference is made to the accompanying description and drawings.

BRIEF DESCRIPTION OF THE DRAWINGS

FIG. 1 is a fragmentary cross-sectional view of a heat exchanger embodying the invention;

FIG. 1A is a fragmentary portion of the FIG. 1 structure illustrating one of the steps involved in the assembly operation;

FIG. 2 is a plan view of a portion of the FIG. 1 structure; and

FIG. 3 is a side view of the FIG. 2 portion.

BEST MODE OF CARRYING OUT THE INVENTION

Referring now to the drawings in greater detail, FIGS. 1 and 1A illustrate generally a heat exchanger 10 including upper and lower metal headers 12 secured to a plurality of tubes 14 and having a plastic tank 16 secured to each header in a solderless manner. A gasket 18 is confined between the respective headers and tanks.

More specifically, the header 12 (FIGS. 2 and 3) is formed in a generally rectangular shape, including a peripheral wall 20 having equally spaced notches 22 formed in the top edge thereof. A straight-sided groove 24 is formed adjacent both side wall portions and end wall portions of the peripheral wall 20. A similar straight-sided groove 26 is formed along the length of the longitudinal centerline of the header, communicating between the two end portions of the groove 24. A depression 28 (FIG. 1) having an arcuate-shaped cross-section is formed, in turn, along the entire length of the centerline of the grooves 24 and 26.

Two straight rows of equally spaced openings 30 are formed in the header 12 between the central groove 26 and the two respective side wall grooves 24. A cylindrical flange 32 is formed around each opening 30.

A tube 14, which may be copper, aluminum, or other suitable material, is mounted in each opening 30 and expanded into a tight, leak-proof relationship with the cylindrical flange 32, including annular beads 34 and/or bevels 36 projecting below and above the respective lower and upper ends of each associated cylindrical flange 32, so as to be rigidly retained therein. A plurality of sheet-like fins 38 are secured to the tubes 14 in the vicinity adjacent each upper and lower header 12, serving to increase the heat transfer surfaces of the tubes in the conventional manner.

The plastic tank 16 is formed to include an inlet/outlet passage 40 having suitable connector means 42 formed on the distal end thereof. The plastic tank 16 includes a peripheral wall 44 and an intermediate longitudinal wall 46. A ledge 48 is formed along the outer surface of the wall 44. Oppositely disposed chamfered sides 50 are formed on the ends of the walls 44 and 46, providing a blunt-nosed edge 52 along the full length thereof for alignment with the full length of the depression 28 in the grooves 24 and 26.

At assembly, the gasket 18 is first placed in position in the grooves 24 and 26 in a flat attitude, as shown in FIG. 1A. The tank 16 is lowered onto the header and gasket such that the blunt-nosed edges 52 are adapted to force the center portion of the gasket 18 into the depressions 28 formed in the bottom of the centers of the grooves 24 and 26, as shown in FIG. 1. Once the tank 16 is positioned in this manner, the peripheral wall 20 portions between the notches 22 (FIG. 3) are folded over onto the ledge 48 formed on the outside surface of the peripheral wall 44, as shown in FIG. 1, to retain each tank 16 in position on the respective header 12.

INDUSTRIAL APPLICABILITY

It should be apparent that the invention provides a simplified and efficient solderless tank to header joint wherein a flat gasket may be used therebetween without requiring the application of substantial clamping force.

While but one embodiment of the invention has been shown and described, other modifications thereof are possible.

The embodiments of the invention in which an exclusive property or privilege is claimed are as follows:

1. A heat exchanger comprising a header having a peripheral wall, a plurality of rows of tubes, means for securing said header to the ends of each of said tubes, a groove formed in said header adjacent the peripheral wall thereof and intermediate adjacent rows of tubes, a recessed portion formed along the full length of the centerline of said groove, a tank having walls formed so as to be aligned with and mounted in said groove within said peripheral wall and intermediate adjacent rows of tubes, a chamfer formed along each of the inner and outer edges of said tank wall providing a blunt edge at the ends of the chamfers, and a gasket mounted in said groove and deformed along its centerline into said recessed portion and compressed therein by said blunt edge, and means for retaining said tank in position within said peripheral wall.

2. The heat exchanger described in claim 1, and including a plurality of spaced slots formed in the edge of said peripheral wall of said header, and a ledge formed around the outside of the tank wall, said means for retaining said tank in position within said peripheral wall consisting of the bending of the portions of the peripheral wall between said slots onto said ledge.

3. A heat exchanger comprising a plurality of rows of tubes, a header including a peripheral wall having spaced slots formed in the edge thereof, means for securing said header to the ends of each of said tubes, a groove formed in said header adjacent the peripheral wall thereof and intermediate adjacent rows of tubes, a recessed portion formed along the full length of the centerline of said groove, a tank having walls formed so as to be aligned with and mounted in said groove within said peripheral wall and intermediate adjacent rows of tubes, a ledge formed around the outside of the tank wall, a chamfer formed along each of the inner and outer edges of said tank wall providing a blunt edge at the ends of the chamfers, and a gasket mounted in said groove and deformed along its centerline into said recessed portion and compressed therein by said blunt edge, said tank being retained in position by the bending of the portions of the peripheral wall between said slots onto said ledge.

* * * * *